US005397236A

United States Patent [19]

Fegg et al.

[11] Patent Number: 5,397,236

[45] Date of Patent: Mar. 14, 1995

[54] METHOD FOR OFFERING A COMPOSITE DUMMY TARGET FORMED FROM A PLURALITY OF ACTIVE MASSES WHICH EMIT SPECTRALLY DIFFERENTIATED RADIATION

[75] Inventors: Martin Fegg, Berchtesgaden; Heinz Bannasch, Schönau; Martin Wegscheider, Bayerisch Gmain, all of Germany

[73] Assignee: Buck Werke GmbH & Co., Bad Uberkingen, Germany

[21] Appl. No.: 152,318

[22] Filed: Nov. 12, 1993

[30] Foreign Application Priority Data

Nov. 11, 1992 [DE] Germany ..... 42 38 038.3

[51] Int. Cl.[6] ..... F41A 33/00

[52] U.S. Cl. ..... 434/11; 434/25; 273/348.1

[58] Field of Search ..... 434/11, 14, 25; 89/1.11, 36.01; 273/348.1

[56] References Cited

U.S. PATENT DOCUMENTS 5,331,897 7/1994 Handler ..... 89/1.11 X

FOREIGN PATENT DOCUMENTS 2911639 12/1982 Germany ..... 434/11
3311539 10/1984 Germany .
3421734 12/1985 Germany .
4007811 12/1993 Germany ..... 89/1.11
2121148 12/1983 United Kingdom ..... 434/11

*Primary Examiner*—Gene Mancene
*Assistant Examiner*—Jeffrey A. Smith
*Attorney, Agent, or Firm*—Hill, Steadman & Simpson

[57] ABSTRACT

In a method for offering a dummy target which simulates the target signature of a subject, such as land craft, aircraft or water craft, to an imaging, radiation-sensitive homing head such as an infrared homing head, a number of active masses are deployed at respective spatial positions, with each mass simulating a portion of the target signature of the subject by emitting spectrally differentiated radiation in the sensitivity range of the homing head. The active masses are deployed at positions to produce a three-dimensional dummy target in which sources of radiation to which the homing head is sensitive are positioned in a manner which mimics the subject.

13 Claims, 3 Drawing Sheets

METHOD FOR OFFERING A COMPOSITE DUMMY TARGET FORMED FROM A PLURALITY OF ACTIVE MASSES WHICH EMIT SPECTRALLY DIFFERENTIATED RADIATION

BACKGROUND OF THE INVENTION

1. Field of the Invention

The present invention is directed to a method for offering a dummy target which simulates the target signature of a subject such as a land craft, aircraft or water craft for an imaging, radiation-sensitive homing head with spectral discrimination capability, such as an infrared homing head.

2. Description of the Prior Art

German OS 33 11 530 discloses a method wherein the dummy target, which is intended to achieve a simulation of a ship-like target signature, is deployed outside a water craft which is to be simulated. The dummy target is placed in the desired position by a submarine. A disadvantage of this known technique is that the dummy target must be completely constructed using a single active mass, and a three-dimensional signature can thus only be achieved to an extremely coarse degree, and without chronological stabilization. Moreover, a spatially disbursed spectral distribution of the active mass is not possible using this known technique.

Moreover, it is known to employ simple, hot pyrotechnic noise radiators as dummy targets for aircraft, armored vehicles and ships as countermeasures against infrared homing heads, with the infrared dummy targets approximating the subject to be protected to a certain extent, at least in terms of area size and spectral radiation components. As disclosed in German OS 34 21 734, the dummy targets produced in this manner may be gradually moved away from the subject to be protected by utilizing a plurality of active masses, which are deployed in chronological succession.

The following infrared deception techniques are currently widely employed: burning fuel, pyrotechnical active masses having metallic components (for example, magnesium/polytetrafluorethylene), pyrotechnical active compounds on carrier materials (flares), and "warm clouds" produced by exothermal chemical reactions. All of these techniques have the common disadvantage that they produce points, or at most structureless clouds, in the infrared range, which have nothing in common with the actual contour and infrared signature of a military object. This results in these deception principles being completely ineffective against "smart" imaging homing heads, particularly infrared homing heads of the so-called third generation.

SUMMARY OF THE INVENTION

It is an object of the present invention to provide a method for offering a dummy target which simulates the target signature of a subject to a so-called smart homing head which is sensitive to subject contours and which has spectral discrimination capability.

The above object is achieved in accordance with the principles of the present invention in a method wherein a plurality of active masses are deployed spaced from each other in a manner which simulates at least a part of the three-dimensional target signature of the subject to be protected by emitting radiation in the sensitivity range of the imaging homing head at locations within the dummy target which correspond to the spectrally differentiated target signature of the subject. A three-dimensional dummy target which simulates the target signature of the subject is thereby produced.

The active masses can be deployed in chronological succession to the position of the dummy target, so that the three-dimensional dummy target is continuously produced for a prescribable time span.

The active masses can be positioned under computer control, while conducting a substantially continuous monitoring of the appearance of the dummy target.

The active masses can be deployed by rapid-fire shells.

The rapid-fire shells can be fired from a single projectile firing or launching apparatus, or alternative the rapid-fire shells can be deployed from a plurality of separate launching or firing means.

The rapid-fire shells can be fired with a cadence (repetition rate) so that a "fresh" active mass is deployed at each prescribed active mass location no later than the point in time at which the immediately preceding active mass becomes extinguished.

Rapid-fire shells having a maximum caliber of 40 mm are preferably employed in the inventive method.

Different active masses are deployed to regions of the dummy target which are intended to have a different "attractiveness" to the homing head than the other portions of the dummy target. Infrared emitting masses can be employed at those regions.

Alternatively, the different types of active masses can be obtained by using granulated phosphorus and phosphorus flares with different ratios in the pyrotechnic mixture, with a first type of active mass having a higher proportion of granulated phosphorus being utilized to simulate relatively cool surfaces of the subject, and the second type of active mass having a lower proportion of granulated phosphorus being used to simulate relatively warm surfaces of the subject.

The active masses of the first type may contain approximately 80% granulated phosphorus and approximately 20% phosphorus flares, and the active masses of the second type can contain approximately 25% granulated phosphorus and approximately 70% phosphorus flares.

Active masses having a resolution size of at least 10 meters are preferably employed.

The invention is based on the perception a three-dimensional target having a high degree of "deceptive similarity" to an imaging homing head such as an infrared head can be produced by rapid-fire ammunition having a relatively small caliber, to deploy spatially and/or chronologically offset active masses at locations within a dummy target to be constructed which reproduces the radiation signature of the subject to be protected, at least in the radiation range to which the homing head is sensitive. Different active masses are preferably employed in order to be able to reproduce surfaces of the subject to be protected which differ in temperature, for example the stern of a ship with respect to the stack or stacks of the ship of, for example, a destroyer or an ammunition transport or the like. These regions of such ships are warmer than the remainder of the ship, and thus present a different spectral attractiveness to the homing head. The simulation method disclosed herein produces a dummy target which is as true-to-life as possible, with regard to radiation emission.

DESCRIPTION OF THE PREFERRED EMBODIMENTS

Figure 1:
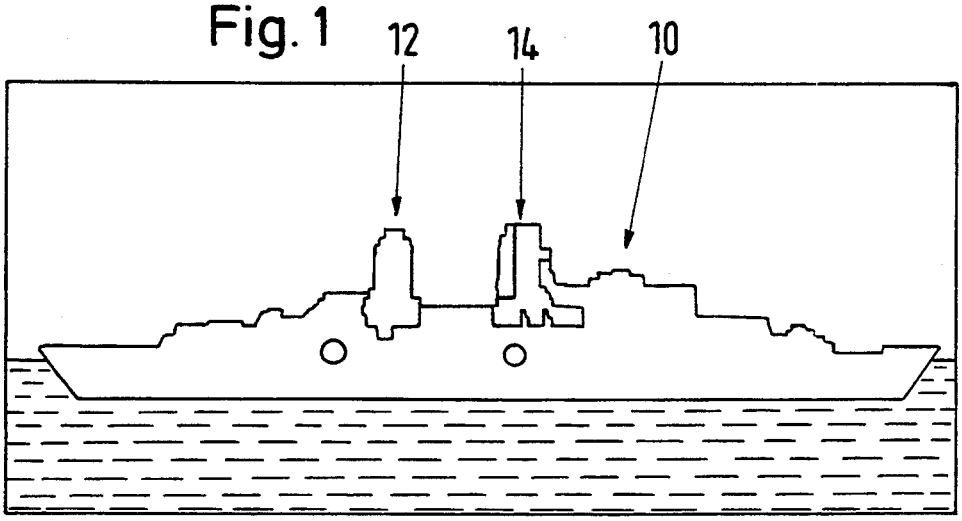
FIG. 1 shows an infrared target signature of a destroyer, as a subject to be protected.

A typical infrared signature of a destroyer 10 is shown in FIG. 1, in which it can be seen that two "hot spots" are present at the respective locations of the two stacks 12 and 14, while the stern of the destroyer has a relatively uniform surface temperature which is lower than the temperature in the region of the two stacks 12 and 14.

Figure 2:
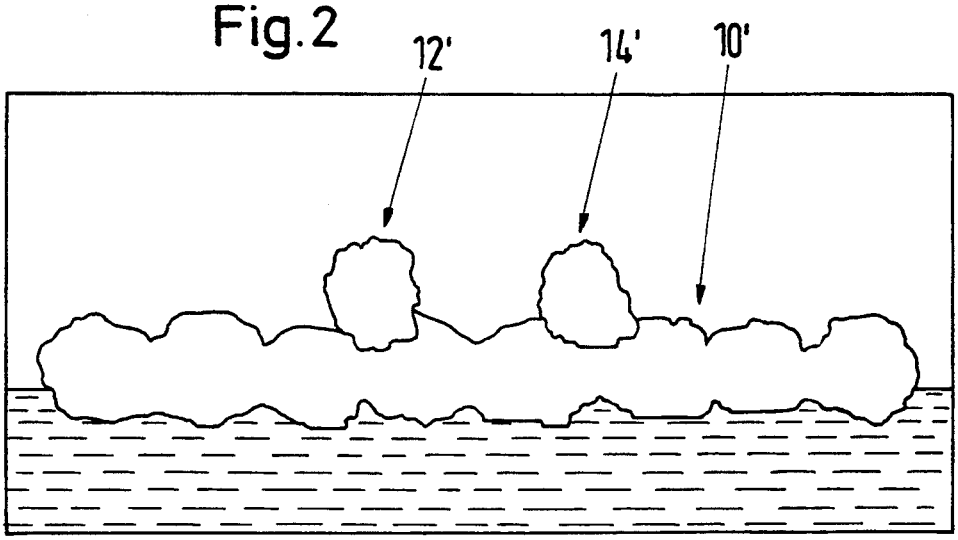
FIG. 2 shows a three-dimensional infrared dummy target of the destroyer of FIG. 1, produced using the method of the invention.
Figure 3:
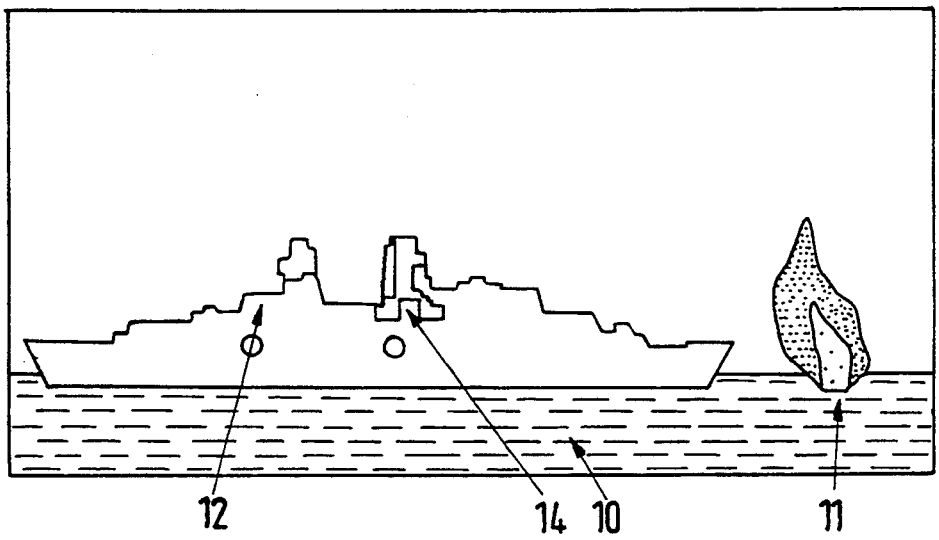
Fig. 3 (PRIOR ART)
FIG. 3 shows a conventional dummy target produced according to a known method, together with a destroyer as shown in FIG. 1.

A dummy target 10' produced in accordance with the method of the invention is shown in FIG. 2, and can also be seen to have two "hot spots" 12' and 14' at the respective locations of the stacks 12 and 14 of FIG. 1, while a region at a position corresponding to the stern presents an essentially uniform surface temperature. The three-dimensional infrared dummy target shown in FIG. 2 presents a high degree of similarity to the destroyer of FIG. 1 to a smart infrared homing head, so that the homing head will attack the dummy target instead of the destroyer, if the overall dummy target is made more "attractive" for the homing head than the destroyer, on the basis of appropriate radiant intensities and/or radiances, etc. A dummy target produced in a conventional manner using a flare 11 is shown in FIG. 3. As is readily apparent, this conventional dummy target does not prevent a contour which mimics that of a the subject to be protected, and thus a smart infrared homing head of the third generation would not prefer this conventional dummy target to the actual subject, i.e., the destroyer 10.

Figure 4:
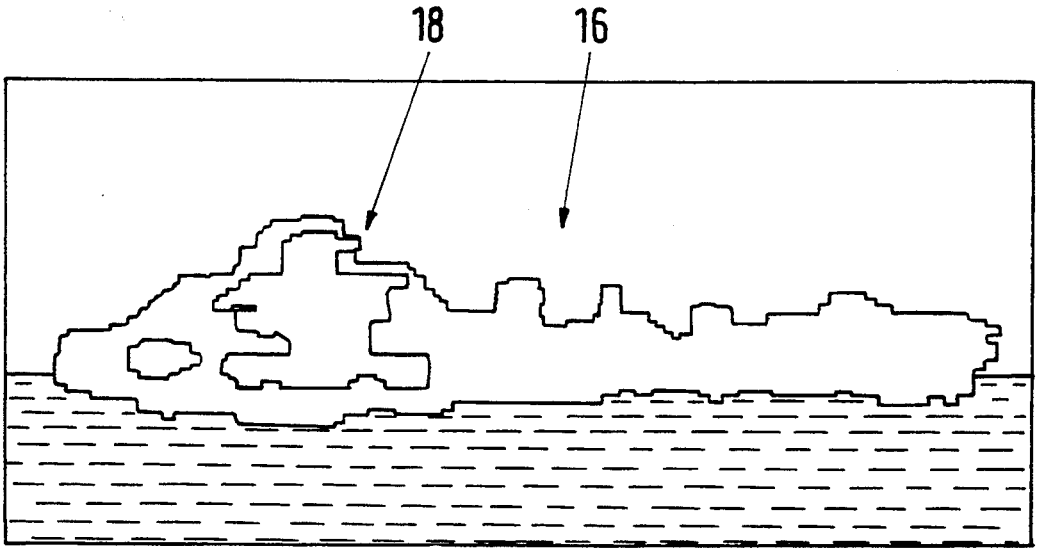
FIG. 4 shows an infrared target signature of an ammunition transport, as a subject to be protected.
Figure 5:
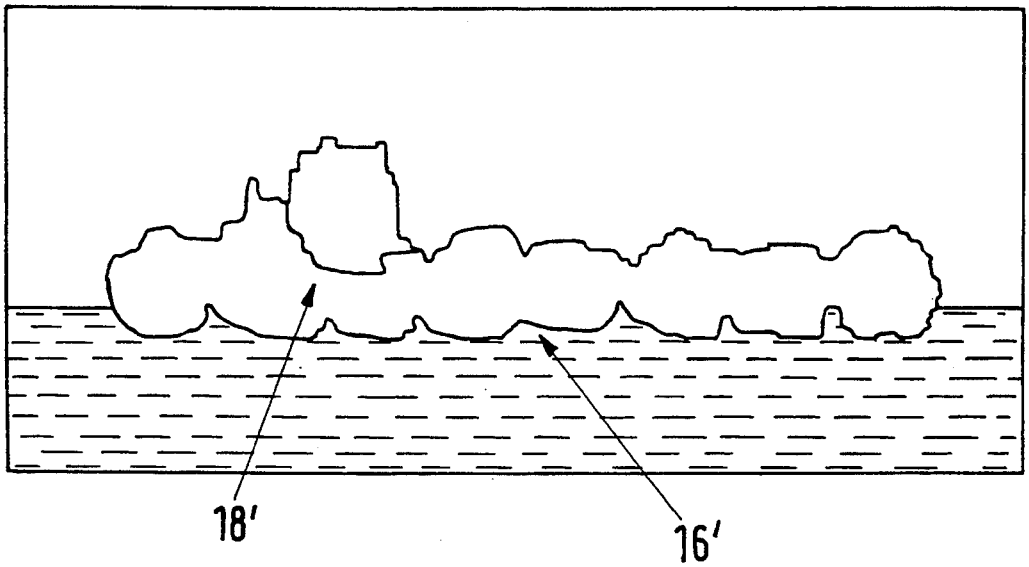
FIG. 5 shows a three-dimensional infrared dummy target of the ammunition transport of FIG. 4 produced in accordance with the method of the invention.

The same can be seen based on a comparison of FIGS. 4 and 5, wherein FIG. 4 shows an ammunition transport 16 having a single stack 18, and FIG. 5 shows an infrared dummy target 16' produced in accordance with the principles of the present invention which has a single "hot spot" 18' at the same location as the stack 18 in the actual subject of FIG. 4.

The invention has been described above in the context of exemplary embodiments for the most frequent application, which is the protection of ships. The method can be easily adapted in other embodiments, however, by appropriate selection of ammunition caliber and ammunition composition, in order to mimic the contour and spatial-spectral infrared signature for any type of subject. The specific infrared criteria of the subject to be protected (shape, area size, spatial-spectral radiation distribution, motion behavior) are simulated in accordance with the principles of the present invention in a manner which is true to the original subject. Simultaneously, the radiant intensity of the dummy target is enhanced compared to that of the subject, so that dummy target represents a more "attractive" target for the infrared homing head. The true-to-form three-dimensional simulation also offers the advantage that the dummy target produced by the inventive method is effective for all threatening directions, and is thus effective for a plurality of simultaneous attacks from different directions.

In the case of infrared dummy targets (the principles of the invention being also employable, for example, for radar-controlled homing heads, sound-controlled attack objects, etc.), a three-dimensional dummy target can be achieved by the method of the invention by rapid and continuous targeted discharge of specific pyrotechnic active masses according to the following basic principles. A discharge sequence is employed with a high cadence, for example more than three firings (discharges) per second. The active masses are deployed using small caliber ammunition, preferably 40 mm and smaller, which makes possible the use of rapid-fire grenade launchers to deploy the active masses. A plurality of pyrotechnic infrared active masses can be deployed having respectively different radiation characteristics so as to mimic as closely as possible the spectral radiation characteristics of the subject. Lastly, the discharge can take place under manual control, but preferably takes place under the control of a computer, whereby the infrared dummy target is produced according to a prescribed pattern by the use of digital image processing of a thermal image obtained at the location of the discharge. The pyrotechnic active masses can thus be continuously replaced (refreshed). The dummy target can even be made to simulate a travel motion by successively displacing the discharge direction, in accordance with the principles taught in German OS 34 21 734.

A firing sequence having a high repetition rate is important in the implementation of the method in order to fill-in voids in the infrared pattern caused by gradually extinguishing and sinking (falling) active masses, as well as due to wind drift, as quickly as possible. A high firing repetition rate also permits the dummy target to be constructed as quickly as possible, given the approach of an infrared homing head. A repetition rate of three shots per second is appropriate for ships in order to construct a three-dimensional dummy target using approximately 5 to 7 infrared active masses in two seconds, and to maintain such a dummy target for the desired time span. In general, the degree of similarity of the infrared pattern of the dummy target to that of the subject becomes more precise as the repetition rage becomes higher.

Small calibers (approximately 40 mm and smaller) are utilized in order to be able to generate the shape, area and infrared target signature as true to the details of the subject as possible. Moreover, small calibers offer the advantage of permitting higher firing sequences. Generally, the infrared simulation of the subject (i.e., degree of resolution) becomes higher as the caliber becomes smaller.

On the other hand, the caliber size limits the number of active masses (or more precisely, the number of active mass positions) with which the dummy target can be constructed, due to the quicker burning period typically exhibited by the smaller caliber projectiles. For example, it is not possible to construct a uniform dummy target when the effective duration (i.e., burning period) of a position (i.e, an active mass or projectile) amounts to approximately 3 seconds. It is necessary for the burning period to last approximately 4 seconds dependent on the selected repetition rate.

The following quantities will be used in the calculations described below:

K: cadence in firings per second

B: effective duration of the active mass in seconds

Z: maximally possible positions (=active masses) of the dummy target of a firing sequence n: firing sequence (n=1 corresponds to the built-up of the dummy target, n=2 corresponds to the first re-approach, n=3 corresponds to the second re-approach, etc.)

m: position identifier of the active mass in the dummy target $t_{n,m}$: breakdown time of the active compound at position m in the firing sequence n after the first breakdown Δt: time between the breakdowns at one position The following relationship is valid for the maximum number of active masses of a firing sequence:

$$Z=K\cdot B$$

Example:

$$K=4s^{-1}$$

$$B=3s$$

$$Z=4s^{-1}$$

$$3s=12$$

The following relationship was calculated for the breakdown time of the active mass at a position m in a firing sequence consisting n firings, after the first breakdown:

$$t_{n,m}=1/K(m-1)+B(n-1)$$

Example:

$$K=4s^{-1},B=3s,m=7,n=3$$

$$t_{n,m}=(1/4s)^{-1}(7-1)+3s(3-1)=7.5s$$

The following is valid for the time between the breakdowns at one position:

$$\Delta t=\frac{Z}{K}$$

The following timetable shows a example of a firing sequence:

| | | $K = 4s^{-1}; B = 3 s \rightarrow Z = 12 \Delta t = 3 s$ | | | |
|---|---|---|---|---|---|
| m | n | 1 | 2 | 3 | — n = x (x E N +) |
| 1 | | 0 | 3 | 5 | — $t_{x,1} = 3 s (x - 1)$ |
| 2 | | 0.25 | 3.25 | 5.25 | — $t_{x,2} = 0.25 s + 3 s (x - 1)$ |
| 3 | | 0.5 | 3.5 | 5.5 | — . |
| 4 | | 0.75 | 3.75 | 5.75 | — . |
| 5 | | 1 | 4 | 6 | — . |

-continued

| | | $K = 4s^{-1}; B = 3 s \rightarrow Z = 12 \Delta t = 3 s$ | | | |
|---|---|---|---|---|---|
| m | n | 1 | 2 | 3 | — n = x (x E N +) |
| 6 | | 1.25 | 4.25 | 6.25 | — . |
| 7 | | 1.5 | 4.5 | 6.5 | — |
| 8 | | 1.75 | 4.75 | 6.75 | — |
| 9 | | 2 | 5 | 7 | — |
| 10 | | 2.25 | 5.25 | 7.25 | — |
| 11 | | 2.5 | 5.5 | 7.5 | — |
| 12 | | 2.75 | 5.75 | 7.75 | — $t_{x,12} = 2.75 s + 3 s (x - 1)$ |

The resolution time in the above table is in seconds.

It should be noted that a ship (as other vehicles) does not have a uniform surface temperature, but instead has large-area zones with clear temperature differences. Given a ship, as in the examples of FIGS. 1 and 2, and FIGS. 4 and 5, as well as the illustration of FIG. 3 showing the prior art, the temperature zones which are most frequently visible in the thermal image are the stern, which is solarly heated (approximately 40° through 60° C.) and the hot stack or stacks (approximately 100° C.) which form so-called "hot spots." The stacks are more clearly emphasized due to their higher temperature (corresponding to the radiance). In order to produce an infrared signature that is true to the original, two types of active masses can be fired in this case, these having respectively different spectral properties.

Figure 6:
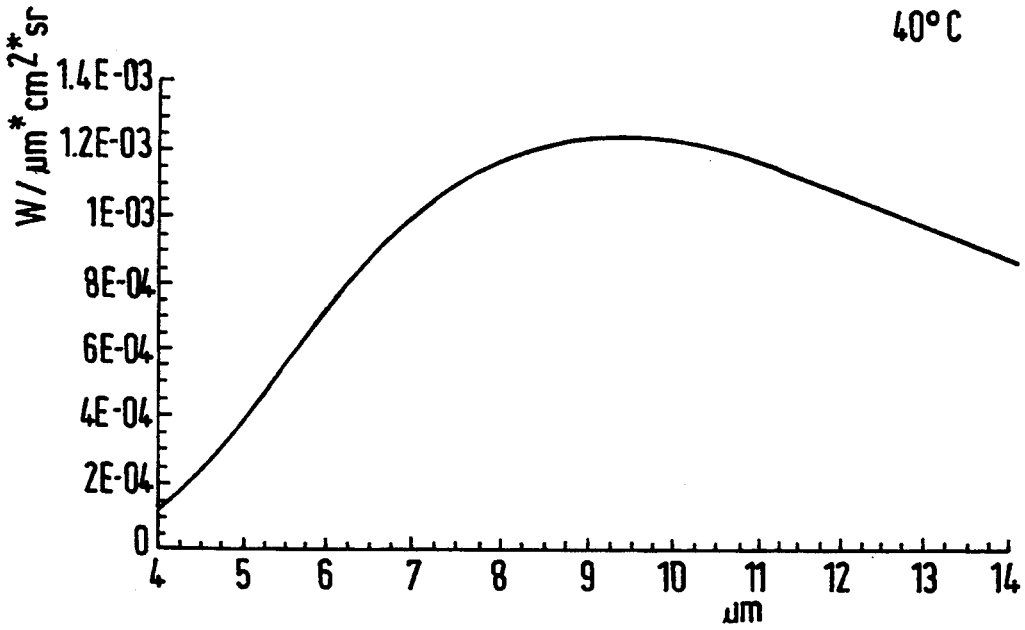
FIG. 6 is a graph showing the spectral radiance of a black body radiator having a surface temperature of 40° C.

A first type of active mass, whose black body radiation curve is shown in FIG. 6, is employed for spatially and spectrally simulating the stern of the ship. As can be seen in FIG. 6, the radiation maximum ($\lambda_{max}$) for the spectral radiance (corresponding to the temperature) of the stern of the ship is in the proximity of $\lambda_{max}=10$ μm according to Planck's radiation law, or Wien's displacement law. The active mass of this first type should therefore produce approximately the same spectral radiance.

This can be achieved by a mixture composed of granulated phosphorus (warm smoke) and small phosphorus flares in the ratio of approximately 80% granulate and 20% flares. This ratio represents a guideline, and can be matched more specifically to various types of ships or other vehicles. The resolution size of the active mass, having a diameter of 10 meters and more (dependent on the resolver charge and the amount of active mass), produces the three-dimensional dummy target, and can be matched to the subject to be protected.

A second type of active mass is employed for the spatial and spectral simulation of the hot spots (stacks). This second type of active mass has a black body radiation curve shown in FIG. 7.

Figure 7:
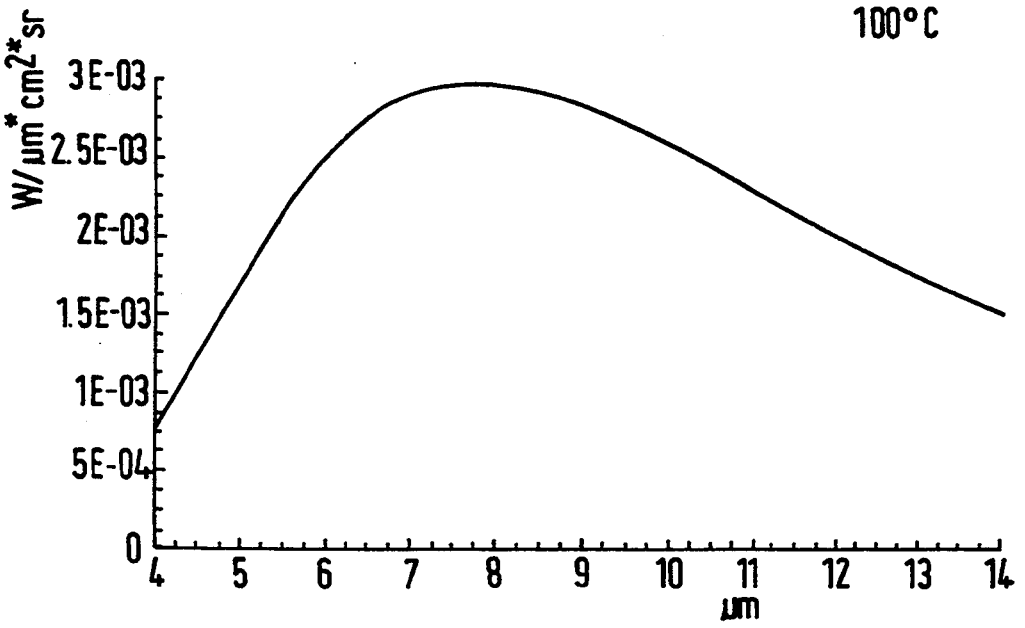
FIG. 7 is a graph showing the spectral radiance of a black body radiator having a surface temperature of 100° C.

As FIG. 7 shows, the radiation maximum for the second type of active mass is in the region of $\lambda_{max}7$ μm for the spectral radiance of a stack according to Planck's radiation law, or Wien's displacement law.

The active mass of the second type should produce approximately the same spectral radiance.

This can be achieved by using the same substances as for the first type of active mass, but with a modified mixing ratio. As a guideline, one can use approximately 75% small flares with a 25% content of granulated phosphorus. The spatial expanse is produced by the resolution size of the active mass (a diameter of 10 m or more, dependent on the resolver charge and the quantity of active mass) and can be matched to the expanses of the subject.

In the above discussion, the composition of first and second types of active masses are understood to mean the composition of the ammunition which is used to produce those masses.

Other types of ammunition having varying mixing ratios of granulated phosphorus relative to flares, or to other active masses (two-color flares, etc.) can also be utilized to simulate different subjects.

In the simplest case, the types of ammunition are belted (i.e., arranged in a proper sequence on an ammunition belt), and are fired from a single projectile firing or launching means, so that a previously defined ammunition sequence must be observed. For example, firings 1 through 3, 5 through 7, 9 through 11, etc. can be of the first type of ammunition for producing the first type of active mass, and firings 4, 8, 12, etc.: can be of the second type of ammunition for producing the second type of active mass.

It is possible, however, to fire or launch from two or more projectile launching or firing means, with one launching or firing means preferably discharging only one ammunition type.

The control of the deployment (firing sequence and firing direction) is preferably undertaken by a computer system, in combination with a digital evaluation of the thermal image of the dummy target. Corresponding to the subject shape and its infrared signature, the computer control designates deployment parameters which produce the desired dummy target pattern. The thermal image of the dummy target pattern is obtained, and is supplied to the computer which automatically monitors the correspondence of the thermal image of the dummy target to that of the original, and compensates for any voids in the pattern which may have arisen due to wind drift or due to the extinguishing of the active masses. This compensation is accomplished by specifically targeted, continuous refreshing of the dummy target.

The monitoring of the thermal image ensues pixel-by-pixel over the entire thermal image (as can be obtained, for example, in a system available from Barr & Stroud designated Barr & Stroud IR 18, which generates an image consisting of 512 pixels in a range of 8 to 13 $\mu$m). Each pixel can be considered to be a quasi-punctiform radiometer.

When the thermal image is processed using digital image processing, a pixel index (i.e., brightness value) is obtained for each pixel. This index is proportional to the radiance of the corresponding portion of the image. When the geometrical data associated with the field of view of the thermal imaging apparatus are taken into account, the computer can then identify both the firing coordinates and the type of ammunition for the next firing sequence based on the image coordinates together with the image indices, in order to achieve optimum coincidence with the stored infrared ship pattern in shape and spectral signature.

Although the computer will position the dummy target relative to the subject to be protected dependent on the tactical situation, the most favorable location will normally be to place the dummy target between the subject and the infrared homing head at a distance of approximately 50 m through 100 m from the subject. A progressive separation between the dummy target and the object to be protected can ensue by successive displacement of the firings used to refresh the dummy target, as well as due to traveling maneuvers on the part of the object such as a ship. The infrared homing head is drawn away from the ship due to the enhanced radiant intensity of the dummy target compared to the ship.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for offering a dummy target simulating the target signature of a subject to an imaging, radiation-sensitive homing head, comprising the step of:

deploying a plurality of active masses in a spatial orientation, with individual active masses respectively simulating one part of said target signature by emitting spectrally differentiated radiation in the sensitivity range of said imaging homing head, for producing a three-dimensional dummy target simulating the spatial and spectral target signature of said subject to said homing head.

2. A method as claimed in claim 1 further defined by deploying said active masses in a chronologically offset sequence for continuously producing said three-dimensional dummy target for a predetermined time span.

3. A method as claimed in claim 1 further defined by deploying said active masses under computer control with substantially continuous monitoring of said three-dimensional dummy target.

4. A method as claimed in claim 1 further defined by deploying said active masses by rapid-fire shells.

5. A method as claimed in claim 4 further defined by deploying said rapid-fire shells from a single projecting apparatus.

6. A method as claimed in claim 4 further defined by deploying said rapid-fire shells from a plurality of projecting apparatuses.

7. A method as claimed in claim 1 further defined by deploying said active masses by rapid-fire shells fired in a cadence so that a new active mass arrives at each active mass location no later than a point in time at which a proceeding active mass at said active mass location becomes extinguished.

8. A method as claimed in claim 1 further defined by deploying said active masses with rapid-fire shells having a caliber not exceeding 40 mm.

9. A method as claimed in claim 1 further defined by deploying different active masses for different regions of said three-dimensional dummy target having a different attractivity to said homing head.

10. A method as claimed in claim 1 further defined by deploying infrared-radiating masses as said active masses.

11. A method as claimed in claim 1 further defined by deploying active masses respectively containing granulated phosphorous and phosphorous flares in different ratios, deploying a first type of active mass having a higher proportion of granulated phosphorous for simulating relatively cool surfaces of said subject and deploying a second type of active mass having a lower proportion of granulated phosphorous for simulating relatively warmer surfaces of said subject.

12. A method as claimed in claim 11 further defined by deploying masses of said first type containing approximately 80% granulated phosphorous and approximately 20% phosphorous flares and deploying masses of said second type containing approximately 25% granulated phosphorous and approximately 70% phosphorous flares.

13. A method as claimed in claim 1 further defined by deploying active masses having a resolution size of at least 10 meters.

* * * * *